US005558512A

United States Patent [19]

Fujiwara et al.

[11] Patent Number: 5,558,512

[45] Date of Patent: Sep. 24, 1996

[54] FLUID COMPRESSOR WITH VERTICAL LONGITUDINAL AXIS

[75] Inventors: Takayoshi Fujiwara, Tokyo; Masayuki Okuda; Yoshinori Sone, both of Yokohama; Takashi Honjo, Kawasaki, all of Japan

[73] Assignee: Kabushiki Kaisha Toshiba, Japan

[21] Appl. No.: 321,778

[22] Filed: Oct. 12, 1994

Related U.S. Application Data

[62] Division of Ser. No. 175,243, Dec. 29, 1993, Pat. No. 5,388,969.

[30] Foreign Application Priority Data

Jan. 12, 1993 [JP] Japan ..... 5-003314

[51] Int. Cl.[6] ..... F04C 18/22

[52] U.S. Cl. ..... 418/188; 418/220

[58] Field of Search ..... 418/188, 220; 417/356, 410.3

[56] References Cited

U.S. PATENT DOCUMENTS

| | | | |
|---|---|---|---|
| 2,953,993 | 9/1960 | Stickland et al. | 417/356 |
| 3,164,096 | 1/1965 | Hallerback | 417/356 |
| 4,871,304 | 10/1989 | Iida et al. | 418/220 |
| 5,028,222 | 7/1991 | Iida et al. | 418/220 |
| 5,062,778 | 11/1991 | Hattori et al. | 418/220 |
| 5,090,874 | 2/1992 | Aikawa et al. | 417/356 |
| 5,125,805 | 6/1992 | Fujiwara et al. | 417/356 |
| 5,151,021 | 9/1992 | Fujiwara et al. | 418/220 |
| 5,174,737 | 12/1992 | Sakata et al. | 418/220 |
| 5,242,287 | 9/1993 | Fujiwara | 418/220 |
| 5,249,931 | 10/1993 | Fujiwara et al. | 417/356 |

FOREIGN PATENT DOCUMENTS

| | | | |
|---|---|---|---|
| 3199689 | 8/1991 | Japan | 418/220 |
| 4112987 | 4/1992 | Japan . | |

*Primary Examiner*—John J. Vrablik

*Attorney, Agent, or Firm*—Cushman Darby & Cushman, LLP

[57] ABSTRACT

A fluid compressor includes a piston which has a vertical longitudinal axis. A plurality of working chambers are provided between a cylinder and the piston, and are constituted by upper working chambers and lower working chambers which separated from each other by a center portion of the piston. Fluid is sucked in the lowermost one of the upper working chambers and the uppermost one of the lower working chambers, respectively, and is compressed while being conveyed. The diameter $\phi$ D3 of a lower shaft portion of the piston and the diameter $\phi$ D4 of an upper shaft portion of the piston have a relationship $\phi$ D3 <$\phi$ D4 in order to apply an upward thrust force to the piston.

1 Claim, 4 Drawing Sheets

$(D_1^2+D_2^2)>D_C^2$

FLUID COMPRESSOR WITH VERTICAL LONGITUDINAL AXIS

This is a division of application Ser. No. 08/175,243, filed Dec. 29, 1993, U.S. Pat. No. 5,388,969.

BACKGROUND OF THE INVENTION

1. Field of the Invention

The present invention relates to a fluid compressor with a vertical longitudinal axis for use, e.g. in a refrigerating apparatus, the fluid compressor sucking a low-pressure refrigerant gas and discharging a high-pressure compressed gas.

2. Description of the Related Art

The inventor of the present invention proposed a fluid compressor, e.g. in Japanese Patent Application No. 2-228000.

In this proposed apparatus, a cylinder and a piston are eccentrically arranged within a sealed casing, and the piston is provided with a helical groove having a pitch decreasing from one end towards the other end. A similarly helical blade is fitted in this groove so that the blade can project from and retreat in the groove.

The space between the piston and the cylinder is divided into a plurality of working chambers.

A rotor is situated around the cylinder, and an annular stator is fixed on the inner wall of the sealed casing with a small gap between itself and the outer periphery of the rotor. The rotor and the stator constitute a motor.

Power is supplied to the motor so that the rotor and cylinder can rotate as one unit. The torque of the cylinder is transmitted to the piston via a torque transmission mechanism. Thus, the cylinder and piston rotate synchronously at a relative circumferential speed, with the positional relationship therebetween maintained.

In accordance with the rotation, the blade projects from and retreats in the groove in the radial direction of the piston.

A refrigerant gas in a refrigerating cycle is sucked in the cylinder, conveyed from the suction-side working chamber to the discharge-side working chamber. While the gas is conveyed, it is gradually compressed.

The refrigerant gas pressurized up to a predetermined level is once discharged to the internal space of the sealed casing and then returned to the outside of the compressor via an exhaust pipe connected to the sealed casing.

In the above type of fluid compressors, the longitudinal axes of rotational parts such as a piston and a cylinder are, in general, situated horizontally. However, in some types of refrigerating apparatuses, the axes of such rotational parts are situated vertically, because of the limited space occupied by other structural parts.

In the compressors having rotational parts with vertical longitudinal axes, the rotational parts tend to descend due to their own weights.

When the rotational parts are stopped, the lower end face of the piston abuts on a lower bearing for supporting the piston, but this abutment state remains unchanged at the time of rotation.

Specifically, the piston comprises a piston body and upper and lower shaft portions integrally formed at the upper and lower ends of the piston body. At the time of rotation, too, the upper surface of the lower bearing functions as a thrust surface and it comes in sliding contact with the lower end face of the piston body.

Accordingly, a very considerable friction loss occurs between the bearing and the piston. Consequently, an increase in electric input is incurred. In the case of a motor with controllable rotation speed, the input increases in accordance with the increase in rotation speed, resulting in a disadvantage in operation costs. Moreover, noise occurs and quiet operation cannot be performed.

SUMMARY OF THE INVENTION

An object of the present invention is to provide a highly reliable fluid compressor having a vertical longitudinal axis and having rotational parts such as a piston and a cylinder with vertical axes, wherein an upward thrust force is made to act on the rotational parts, thereby remarkably decreasing a frictional loss between the piston and a lower bearing, decreasing electric input irrespective of the rotation speed of a motor, and eliminating noise.

According to this invention, there is provided a fluid compressor having a vertical longitudinal axis, comprising: a sealed casing; bearings provided at upper and lower parts of the sealed casing; a rotational body housed within the sealed casing to have a vertical longitudinal axis and including an upper shaft portion and a lower shaft portion supported rotatably by upper and lower bearings, a diameter (ϕD1) of the lower shaft portion and a diameter (ϕD2) of the upper shaft portion being set so as to produce an upward thrust force in accordance with rotation of the rotational body; an electric motor, provided on the rotational body and the sealed casing, for rotating the rotational body; and a compression mechanism for sucking a fluid to be compressed, compressing the fluid and discharging the fluid in accordance with the rotation of the rotational body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 4D show a fluid compressor according to an embodiment of the present invention, in which FIG. 1 is a cross-sectional view of the fluid compressor, FIG. 2 is a side view of a piston or a rotational body, FIG. 3 is a side view of a blade, and FIGS. 4A to 4D illustrate a succession of relative, synchronous rotational movement of the piston and a cylinder;

DETAILED DESCRIPTION OF THE PREFERRED EMBODIMENTS

An embodiment of the present invention will now be described with reference to the accompanying drawings.

Figure 1:
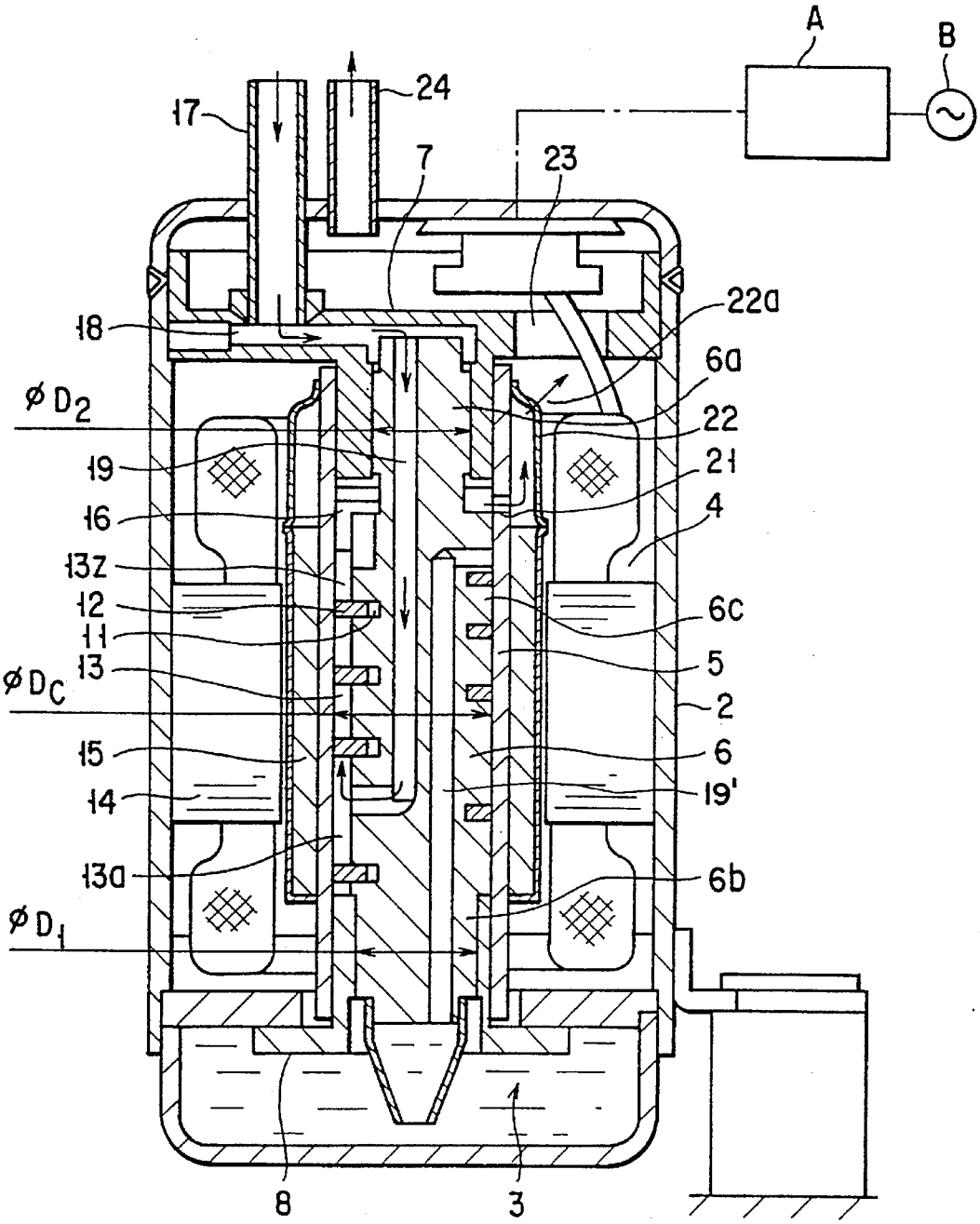

As is shown in FIG. 1, a compression mechanism 3 and motor 4 are housed within an elongated sealed casing 2 having a vertical longitudinal axis.

In the compression mechanism 3, a piston 6 or a rotational body is eccentrically situated within a cylinder 5. The longitudinal axes of the cylinder 5 and piston 6 are situated vertically in accordance with the longitudinal axis of the sealed casing 2.

Upper end portions of the cylinder 5 and piston 6 are supported by a main bearing 7 fixed on the inner wall of the sealed casing 2, and lower end portions thereof are supported by a sub-bearing 8 fixed to the inner wall of the sealed casing 2.

An upper opening end of the cylinder 5 is closed by the main bearing 7 and supported rotatably. A lower opening end of the cylinder 5 is closed by the sub-bearing 8 and supported rotatably.

The piston 6 comprises a piston body 6*c*, a main shaft portion 6*a* or an upper shaft portion formed integral with an upper portion of the piston body 6*c*, and a sub-shaft portion 6*b* or a lower shaft portion formed integral with a lower portion of the piston body 6*c*.

The main shaft portion 6*a* is inserted in the main bearing 7 and supported rotatably, and the sub-shaft portion 6*b* is inserted in the sub-bearing 8 and supported rotatably.

Figure 2:
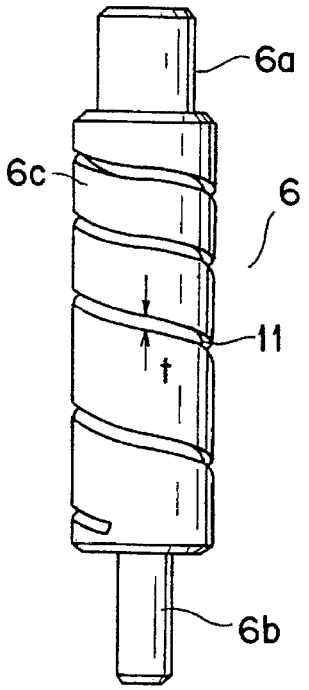
Figure 4A:
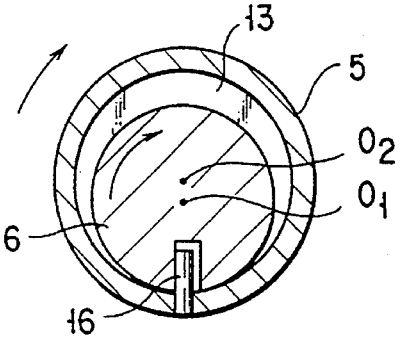
Figure 4C:
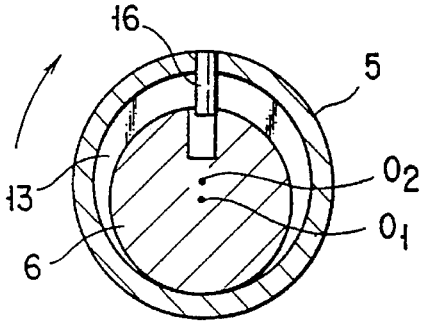
Figure 4B:
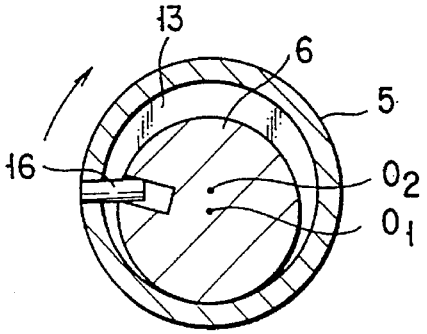
Figure 4D:
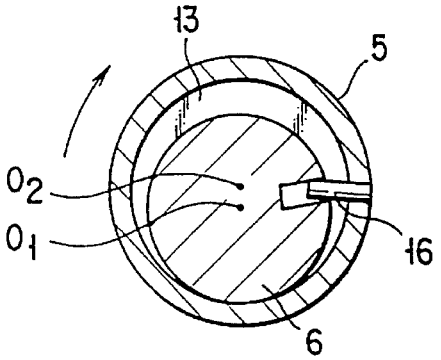

As is shown in FIG. 2, a helical groove 11 is formed in the peripheral surface of the piston body 6*c* of piston 6, the groove 11 having a pitch gradually decreasing from the lower end towards the upper end.

Figure 3:
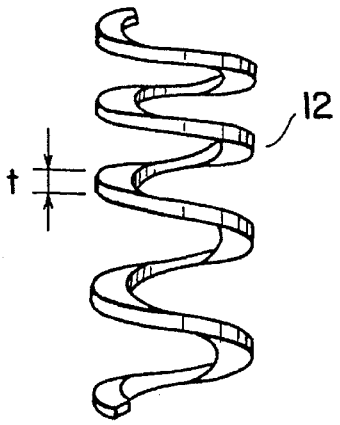

A helical blade 12, as shown in FIG. 3, is fitted in the groove 11 so that it can project from and retreat in the groove 11. The blade 12 is made of, e.g. fluororesin. The wall thickness t of the blade 12 is substantially equal to the width t of the helical groove 11.

Referring back to FIG. 1, the space defined between the piston 6 and cylinder 5 is divided into a plurality of portions by the blade 12 and contact points between the piston 6 and cylinder 5.

Thus, a plurality of working chambers 13 are formed within the cylinder 5. The volumes of the working chambers 13 decrease gradually from the one situated at the lower end of the cylinder 5 towards the one situated at the upper end thereof.

On the other hand, the motor 4 is electrically connected to a commercial power supply B via an inverter circuit A or rotation speed control means. The rotation speed of the motor 4 is controlled in accordance with a load.

The motor 4 comprises an annular stator 14 fixed to the inner wall of the sealed casing 2 and an annular magnet rotor 15 situated inside the stator 14.

The magnet rotor 15 is provided around the cylinder 5. When power is supplied to the motor 4, the magnet rotor 15 and cylinder 5 are rotated as one unit.

An upper end portion of the cylinder 5 is coupled to an upper end portion of the piston body 6*c* via a torque transmission mechanism 16.

The torque transmission mechanism 16 comprises a recess formed, e.g. in the peripheral surface of the piston body 6*c*, and a pin formed on the cylinder 5. This pin projects radially inwards and a distal end portion thereof is inserted in the recess.

Alternatively, the mechanism 16 may comprise a so-called Oldham ring mechanism provided on the cylinder 5 and piston body 6*a*. The structure of the mechanism 16 may be freely designed if a torque of the cylinder 5 can be transmitted to the piston 6.

A suction pipe 17 penetrates an upper end portion of the sealed casing 2. The suction pipe 17 communicates with an evaporator (not shown) constituting a part of a refrigerating cycle.

An end portion of the suction pipe 17, which projects into the casing, is connected to one end opening portion of a guide passage 18 formed in the main bearing 7.

The other end opening portion of the guide passage 18 communicates with an upper end opening portion of a suction passage 19 formed in the piston 6.

The suction passage 19 extends along the axis of the piston 6 from the end face of the main shaft portion 6*a* to the lower part of the piston body 6*c*, such that the axis of the passage 19 is eccentric to that of the piston 6. Further, passage 19' leads to the bottom of the subshaft portion 6*b*.

Further, the suction passage 19 is bent at the lower part of the piston body 6*c* and opens at the peripheral surface of the piston body 6*c*.

A lower end opening of the suction passage 19 is open to the lowermost working chamber 13 partitioned by the blade 12. This lowermost working chamber 13 is referred to as a suction chamber 13*a*.

On the other hand, the uppermost working chamber 13 partitioned by the blade 12 is referred to as a discharge chamber 13*z*.

The cylinder 5 has a discharge port 21 communicating with the discharge chamber 13*z*. A compressed refrigerant gas is discharged from the cylinder 5 through the discharge port 21.

A cover 22 is tightly attached to the periphery of the magnet rotor 15, except an upper end face of the magnet rotor 15, thus holding the rotor 15 to the cylinder 5.

The cover 22 extends from the upper end face of the magnet rotor 15 to the upper end portion of the cylinder 5, thereby defining a sealed space. Accordingly, the discharge port 21 is opposed to this sealed space.

A hole 22*a* is formed at an upper end portion of the cover 22. The refrigerant gas discharged into the sealed space is guided to the outside of the cover 22 through the hole 22*a*.

The main bearing 7 has an opening 23, and an exhaust pipe 24 is connected to the sealed casing 2. The exhaust pipe 24 communicates with a condenser (not shown) constituting a part of the refrigerating cycle.

On the other hand, as has been described above, the piston 6 having the vertical longitudinal axis is provided with the helical groove 11 formed in the piston body 6*c* so as to have the pitch decreasing gradually from the lower portion towards the upper portion.

In the fluid compressor having the above structure, the diameter $\phi D1$ of the sub-shaft portion 6*b* of piston 6, the diameter $\phi D2$ of the main shaft portion 6*a* and the inside diameter $\phi Dc$ of the cylinder 5 must be determined to meet the condition:

$$(D1^2+D2^2)>Dc^2$$

Needless to say, the diameter of the support hole of the sub-bearing 8 for supporting the sub-shaft portion 6*b*, the diameter of the support hole of the main bearing 7 for supporting the main shaft portion 6*a* and the diameter of the piston body 6*c* in relation to the inside diameter of the cylinder 5 must be determined similarly.

when power is supplied to the motor 4 of the fluid compressor having the above structure, the magnet rotor 15 is rotated.

Since the rotor 15 is mounted around the cylinder 5, the rotor 15 and cylinder 5 rotates as one unit. The torque of the cylinder 5 is transmitted to the piston 6 by the torque transmission mechanism 16.

FIGS. 4A to 4D show rotation states of the cylinder 5 and piston 6 successively. The torque transmission mechanism 16 is shown schematically.

Since the cylinder 5 and piston 6 have mutually eccentric axes 02 and 01, as shown in FIGS. 4A to 4D, parts of their peripheral surfaces come into contact constantly.

The cylinder 5 and piston 6 rotate synchronously at a relative circumferential speed, with their positional relationship maintained.

Referring back to FIG. 1, the blade 12 projects from and retreat in the groove 11 in the radial direction of the piston 6 in accordance with the rotation of the cylinder 5 and piston 6.

A low-pressure refrigerant gas is supplied from the evaporator to the suction pipe 17 connected to the sealed casing 2, and then the gas is guided to the suction passage 19 in the piston 6 through the guide passage 18 formed in the main bearing 7.

The gas is introduced into the lowermost suction chamber 13*a* from the lower opening end of the suction passage 19, and is conveyed successively to the discharge chamber 13*z* in accordance with the rotation of the cylinder 5 and piston 6 and the projecting and retreating movement of the blade 12.

The refrigerant gas is gradually compressed while it is conveyed from the suction chamber 13*a* to the discharge chamber 13*z*. In the fluid compressor shown in FIG. 1, the pressure of the refrigerant gas compressed in the working chamber 13 is increased to a predetermined high pressure in the discharge chamber 13*z*.

Then, the refrigerant gas is discharged from the discharge chamber 13*z* into the cover 22 through the discharge port 21, and further discharged from the hole 22*a* formed at the cover 22 into the sealed casing 2. Therefore, the casing 2 is filled with the refrigerant gas having discharge pressure Pd.

The high-pressure gas passes through the opening 23 of the main bearing 7 and the discharge pipe 24 connected to the sealed casing 2, and then it is guided to the condenser situated outside the fluid compressor.

On the other hand, lubricating oil is put in the lower part of the sealed casing 2, and at the lower end portion of the sub-shaft portion 6*b* is immersed in the lubricating oil.

The discharge pressure Pd of the refrigerant gas is applied to the lubricating oil put in the lower part of the sealed casing 2, and applied to the sub-shaft portion 6*b* immersed in the lubricating oil. In other words, the discharge pressure Pd acts on the end face of the sub-shaft portion 6*b* .

Passage 19' formed in the piston 6 is an oil feeding passage for feeding the lubricating oil put into the lower part of the sealed casing 2. A centrifugal oil feeding pump is provided at the lower end portion of the sub-shaft portion 6*b* , and pumps the lubricating oil into the passage 19', in accordance with rotation of the piston 6.

The lubricating oil is fed to the sliding surfaces of the cylinder 5, piston 6, blade 12 and groove 11, which are included in the working chambers 13, as a result of which lubrication of the sliding surfaces and sealing therebetween are improved.

In the compressor operating in the above manner, the weights of the rotational parts such as cylinder 5, piston 6 and magnet rotor 15 act on these parts, with their combinatorial relationship maintained.

When the operation of the compressor is stopped, the rotational parts descend and the lower end face of the piston body 6*c*, which is supported by the above-described supporting structure, abuts on the upper end face of the sub-bearing 8 or the lower bearing.

Specifically, the total weight of all rotational parts acts on the sub-bearing 8, but no problem occurs since the compressor is stopped.

On the other hand, when the compressor is operated, an upward thrust force is produced, since the pitch of the helical groove 11 is set as described above and the diameter ϕD1 of the sub-shaft portion 6*b*, the diameter ϕD2 of the main shaft portion 6*a* and the inside diameter ϕDc of the cylinder 5 is determined to meet the condition:

$$(D1^2+D2^2)>Dc^2.$$

Figure 6:
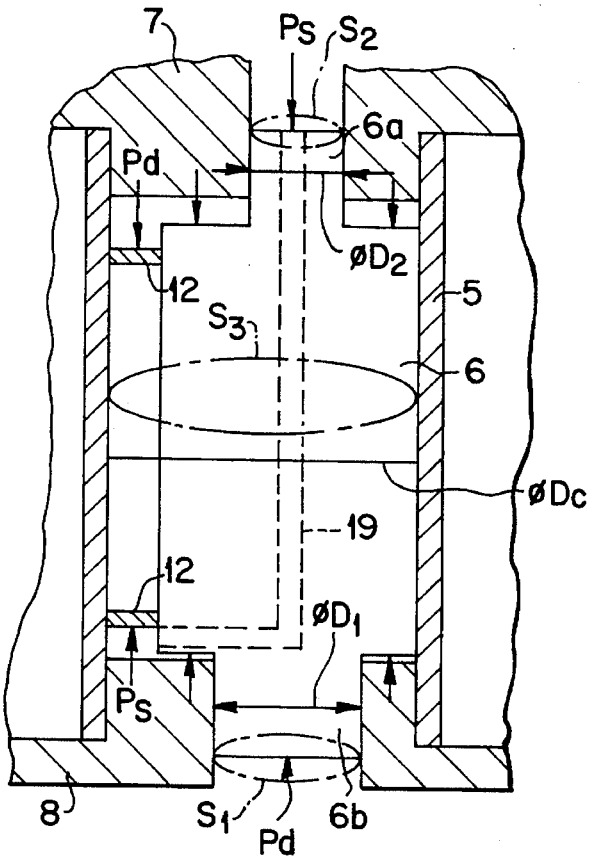
FIG. 6 is a schematic illustration of the cylinder and piston for explaining the generation of a thrust force.

To describe how the thrust force is produced, FIG. 6 schematically shows the cylinder 5, piston 6, blade 12, main bearing 7, sub-bearing 8, and section passage 19.

Symbol Ps denotes a gas suction pressure, Pd a discharge pressure, S1 an area of the lower shaft portion 6*b*, S2 an area of the upper shaft portion 6*a*, and S3 an area of the inside surface of the cylinder 5.

The suction pressure Ps acts on the end face of the upper shaft portion 6*a*, and also acts on the end face of the lower portion of the piston body 6*c* excluding the end face of the lower shaft portion 6*b* and on the side face of the lower-side blade 12 by virtue of the suction passage 19.

The discharge pressure Pd acts on the end face of the lower shaft portion 6*b*, and also acts on the end face of the upper portion of the piston body 6*c* excluding the end face of the upper shaft portion 6*a* and on the side face of the upper-side blade 12 by setting the pitch of the blade 12 (the pitch decreases gradually from the lower side to the upper side).

In operation, the thrust force applied to the piston 6 acts downwardly and upwardly. The downward and upward thrust forces are defined as follows:

The downward thrust force is a sum of the suction pressure Ps acting on the end face of the upper shaft portion 6*a* of the piston 6 and the discharge pressure Pd acting on the end face of the upper portion of the piston body 6*c* excluding the upper shaft portion 6*a* and on the side face of the blade 12 projecting from the piston. Namely, the downward thrust force is given by:

$$Pd(S3-S2)+PsS2$$

The upward thrust force is a sum of the discharge pressure Pd acting on the end face of the lower shaft portion 6*b* of the piston 6 and the suction pressure Ps acting on the end face of the lower portion of the piston body 6*c* excluding the lower shaft portion 6*b* and on the side face of the blade 12 projecting from the piston. Namely, the upward thrust force is given by:

$$PdS1+Ps(S3-S1)$$

Accordingly, in order to obtain the upward thrust force acting on the piston 6, the above relationship, i.e. the upward thrust force > the downward thrust force, is indispensable. That is, by substituting the above formulae, $$PdS1+Ps(S3-S1)>Pd(S3-S2)+PsS2$$

must be established.

From the above, the following formula is obtained:

$$Pd\frac{D1^2}{4}\pi+Ps\left(\frac{Dc^2}{4}\pi-\frac{D1^2}{4}\pi\right)>$$

$$Pd\left(\frac{Dc^2}{4}\pi-\frac{D2^2}{4}\pi\right)Ps\frac{D2^2}{4}\pi$$

This formula is solved as follows:

$$PdD1^2+Ps(Dc^2-D1^2)>Pd(Dc^2-D2^2)+PsD2^2$$

$$PdD1^2+PsDc^2-PsD1^2>PdDc^2-PdD2^2+PsD2^2$$

$$PdD1^2-PsD1^2+PdD2^2-PsD2^2>-PsDc^2+PdDc^2$$

$$(Pd-Ps)D1^2+(Pd-Ps)D2^2>(Pd-Ps)Dc^2$$

thus, $$D1^2+D2^2 22\ Dc^2$$

In addition, the magnitude of the thrust force is substantially equal to the total weight of the rotational parts, and both are balanced. Accordingly, no friction loss occurs between the lower end face of the piston body 6*c* and the upper end face of the sub-bearing 8, nor does noise occur.

If the thrust force is slightly greater than the total weight of the rotational parts, there is no problem and the same effect as the above-described embodiment is brought about. However, it is not possible to design the dimensions of the respective parts such that the thrust force greatly exceeds the total weight of the rotational parts and the rotational parts floats from the sub-bearing 8.

In this case, in particular, the piston 6 becomes unstable in the thrust direction, and the upper and lower end faces of the piston body 6*c* come in contact and come out of contact with the end faces of the main bearing 7 and sub-bearing 8. Consequently, the piston 6 tends to vibrate in the thrust direction, resulting in the same drawback as in the prior art.

Figure 5:
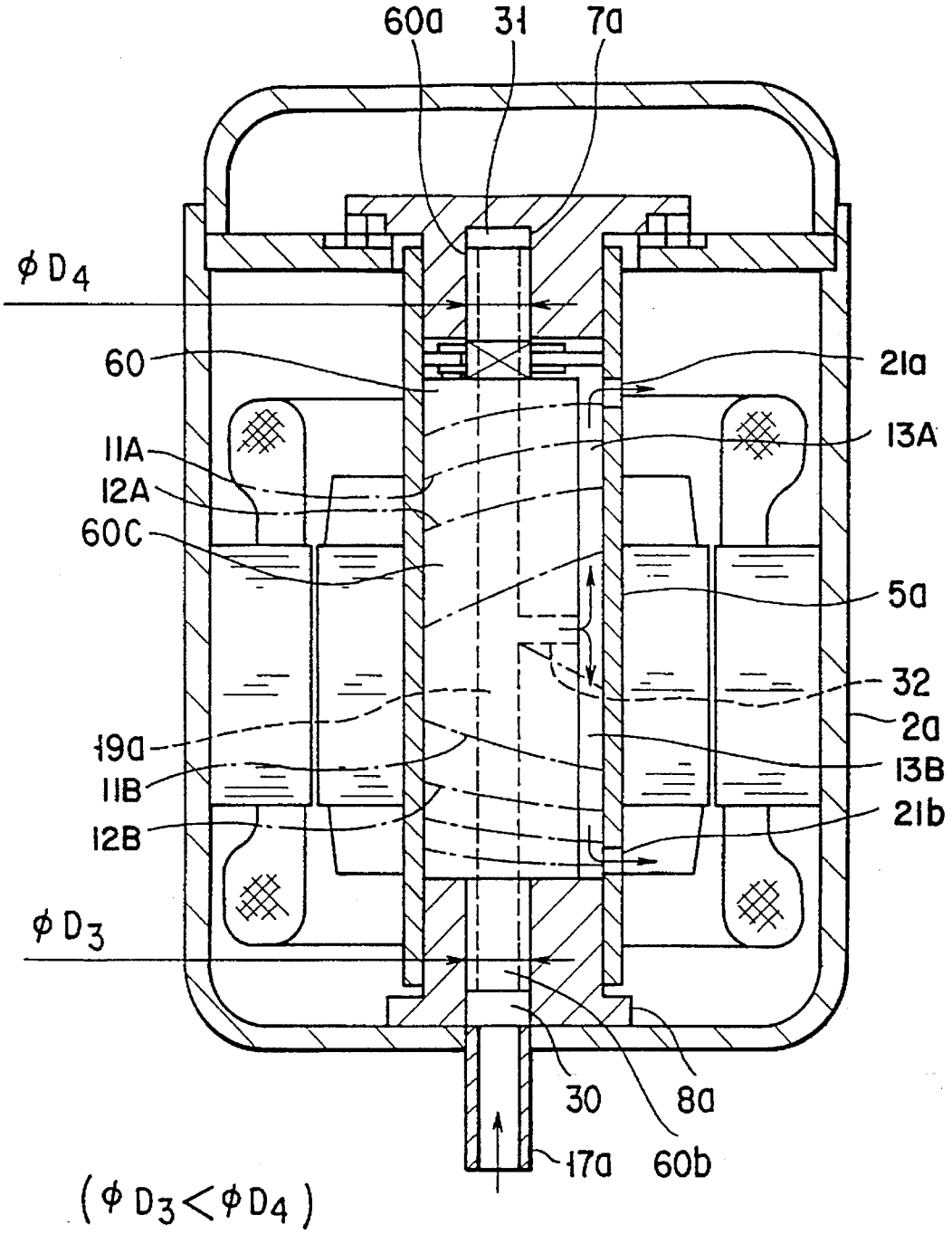
FIG. 5 is a cross-sectional view of a fluid compressor according to a modification of the present invention.

The present invention is also applicable to a so-called "twin type" fluid compressor, as shown in FIG. 5.

Specifically, a piston body 60*c* of a piston 60 is provided with a pair of upper and lower helical grooves 11A and 11B which are situated on both sides of an axial center portion of the piston body 60*c*. Blades 12A and 12B of the same pitch are fitted in the grooves 11A and 11B. A pair of groups of working chambers 13A and 13B are formed on both upper and lower sides of the axially middle portion of the piston 60.

In FIG. 5, the helical grooves 11A and 11B and blades 12A and 12B are indicated by dot-and-dash lines.

A suction pipe 17*a* is connected to a lower part of a sealed casing 2*a*, and it communicates with a support hole 30 formed in a sub-bearing 8*a*.

On the other hand, a suction passage 19*a* is formed to penetrate the piston 60 in its axial direction. More specifically, the suction passage 19*a* is formed to extend from an end face of a sub-shaft portion 60*b* or a lower shaft portion through the piston body 60*c* to an end face of a main shaft portion 60*a* or an upper shaft portion.

The end face of the main shaft portion 60*a* is designed such that a gap of a given distance is provided between the end face of the main shaft portion 60*a* and the bottom of a support hole 31 formed in a main bearing 7*a*.

A branch passage 32 is formed at a substantially middle axial portion of the piston 60 in the suction passage 19*a*, and the branch passage 32 is open to the periphery of the piston body 60*c*. The position of the opening of the branch passage 32 is located between the pair of the helical grooves 11A and 11B.

Accordingly, a refrigerant gas introduced into the suction pipe 17*a* is supplied through the suction passage 19*a* of the piston 60 to upper and lower working chambers 13A and 13B partitioned by the upper and lower blades 12A and 12B and compressed therein.

Discharge ports 21*a* and 21*b* are formed in upper and lower end portions of a cylinder 5*a*, and the compressed gas is discharged to the inside of the sealed casing 2*a*.

In this twin type compressor, an equal suction pressure can be applied to the end face of the sub-shaft portion 60*b* of the piston 60 and the end face of the main shaft portion 60*a*, if the diameter of the sub-shaft portion 60*b* of piston 60 is made to be equal to that of the main shaft portion 60*a*. In this case, when the compressor is driven, a thrust force acting on both end faces of the piston 60 is zero.

However, the weight of the rotational parts such as cylinder 5*a* and piston 60 acts on the thrust face or the upper end face of the sub-bearing 8*a*. Thus, if the thrust force acting on both end faces of the piston 60 is zero, a great load acts on the thrust face of the sub-bearing 8*a* and frictional loss occurs.

Considering the above, if an upward thrust force is made to act on the rotational parts so as to balance with the total weight of the rotational parts, the load on the thrust face of the sub-bearing 8*a* decreases and the frictional loss decreases.

Specifically, in the compressor having this structure, if the diameter ϕD3 of the sub-shaft portion 60*b* is made to be less than the diameter ϕD4 of the main shaft portion 60*a* (ϕD3 <ϕD4), an upper thrust force is applied to the rotational parts so as to balance with the total weight of the rotational parts. Thus, the load on the thrust face of the sub-bearing 8*a* decreases and the frictional loss decreases.

In FIG. 5, the diameter ϕD3 of the sub-shaft portion 60*b* which is the lower shaft portion of the piston 60 is smaller than the diameter ϕD4 of the main shaft portion 60*a* which is the upper shaft portion of the piston 60 (ϕD3 <ϕD4). As a result, an upward thrust force is generated, as explained more fully below.

Figure 7:
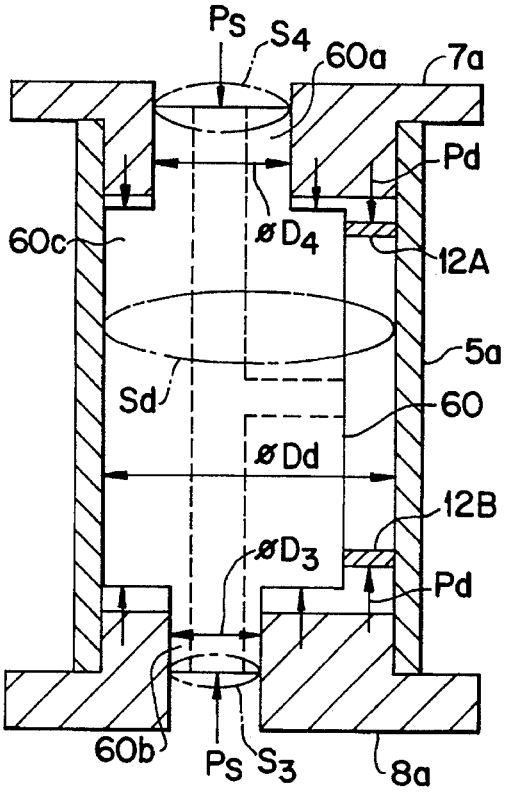
FIG. 7 is a schematic illustration of the cylinder and piston of FIG. 5, for explaining the generation of a thrust force.

FIG. 7 shows the cylinder 5*a*, the piston 60, the blades 12A and 12B, the main bearing 7*a* and the sub-bearing 8*a* in order to explain generation of the thrust force.

In FIG. 7, Ps, Pd, S3, S4 and Sd denote, respectively, a suction pressure of gas, a discharge pressure thereof, the area of the sub-shaft portion 60*b* which is the lower shaft portion of the piston 60, the area of the main shaft portion 60*a* which is the upper shaft portion of the piston 60, and the area of the inner peripheral surface of the cylinder 5*a* which is measured when the inner diameter thereof is ϕ Dd.

The fluid compressor of the present invention is referred to as a twin-type fluid compressor. Specifically, upper working chambers (13A) and lower working chambers (13B) are separated from each other by a center portion of the piston 60 which is centered in the axial direction thereof. Thus, the suction pressure Ps acts on the end face of the main shaft portion 60*a* and the end face of the sub-shaft portion 60*b*.

The discharge pressure Pd acts on the upper end face of the piston body 60*c* (excluding the end face of the main shaft portion 60*a*), the side surface of the upper blade 12A, the lower end face of the piston body 60*c* (excluding the end face of the sub-shaft portion 60*b*), and the side surface of the lower blade 12B.

During the operation of the fluid compressor, the upward and downward thrust forces are generated in the piston 60.

The downward thrust force is equal to the sum of the suction pressure Ps which acts on the end face of the main shaft portion 60*a*, and the discharge pressure Pd which acts on the upper end face of the piston body 60*c* (excluding the main shaft portion), and the side surface of the blade 12A.

In other words, the downward thrust force is $$Pd(Sd-S4)+Ps\bullet S4$$

The upward thrust force is equal to the sum of the suction pressure Ps which acts on the end face of the sub-shaft portion 60*b* and the lower end face of the piston body 60*c* (excluding the sub-shaft portion), and the discharge pressure Pd which acts on the side surface of the blade 12B.

In other words, the upward thrust force is

Ti $Pd(Sd-S3)+Ps\bullet S3$

Therefore, in order for the piston 60 to obtain the upward thrust force, it is necessary to establish the following relationship:

the upward thrust force > the downward thrust force

In order to establish this relationship, it is necessary to satisfy the following formula:

$$Pd(Sd-S3)+Ps\bullet S3>Pd(Sd-S4)+Ps\bullet S4$$

When this formula is solved, the diameter ϕD4 of the main shaft portion 60*a* and the diameter ϕD3 of the sub-shaft portion 50*b* are:

$$Pd \cdot Sd - Pd \cdot S3 + Ps \cdot S3 > Pd \cdot Sd - Pd \cdot S4 + Ps \cdot S4$$
$$-Pd \cdot S3 + Ps \cdot S3 > -Pd \cdot S4 + Ps \cdot S4$$
$$-S3\ (Pd - Ps) > -S4\ (Pd - Ps)$$
$$S4\ (Pd - Ps) > S3\ (Pd - Ps)$$
$$S4 > S3$$
$$\pi\ D4^2/4 > \pi\ D3^2/4$$
$$\phi\ D4 > \phi\ D3.$$

The fluid compressor of the present invention is applicable not only to the refrigerating apparatus but also to other apparatuses and various modifications can be made to this invention, without departing from the spirit of the invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fluid compressor comprising:

a sealed casing:

upper and lower bearings provided at upper and lower parts of the sealed casing, respectively;

a cylinder provided in the sealed casing, the cylinder having upper and lower end opening portions which are rotatably supported by the upper and lower bearings, respectively;

a piston including:

a piston body disposed eccentrically within the cylinder, the piston body having a pair of helical grooves formed in an outer peripheral surface thereof, one of the helical grooves of the pair having a pitch which decreases gradually upwardly from an axial center portion of the piston, the other helical groove of the pair having a pitch which decreases gradually downwardly from the center portion of the piston;

an upper shaft portion which is integrally formed with an upper end portion of the piston body and eccentrically supported by the upper bearing; and a lower shaft portion which is integrally formed with a lower end portion of the piston body and eccentrically supported by the lower bearing, the upper shaft portion of the piston and the lower shaft portion of piston having a diameter ϕD4 and a diameter ϕD3, respectively, which are set so as to apply an upward thrust force to the piston in accordance with rotation of the cylinder and the piston;

blades fitted in the helical grooves such that the blades project from and retract in the grooves in accordance with rotation of the cylinder and piston;

a plurality of working chambers provided in the cylinder and constituted by upper working chambers and lower working chambers which are separated from each other by the center portion of the piston, the upper working chambers being partitioned by one of the blades so as to have capacities decreasing gradually from a lowermost one of the upper working chambers, the lower working chambers being partitioned by another blade so as to have capacities decreasing gradually from an uppermost one of the lower working chambers; and a torque transmission mechanism for rotating the cylinder and the piston synchronously at a relative circumferential speed, and for compressing a fluid which is sucked into the lowermost one of the upper working chambers, while conveying the fluid gradually towards an uppermost one of the upper working chambers, and for compressing a fluid which is sucked into the uppermost one of the lower working chambers, while conveying the fluid gradually towards a lowermost one of the lower working chambers, wherein the diameter ϕD3 of the lower shaft portion of the piston is less than the diameter ϕD4 of the upper shaft portion of the piston such that said upward thrust force produced in accordance with the rotation of the piston is substantially equal to or slightly greater than the total weight of rotational parts.

* * * * *